US009188093B2

(12) United States Patent
Jeon et al.

(10) Patent No.: US 9,188,093 B2
(45) Date of Patent: Nov. 17, 2015

(54) TWO-STAGE FUEL INJECTION VALVE

(75) Inventors: Byung Hyun Jeon, Ulsan (KR); Ju Tae Kim, Ulsan (KR); Kwang Hean An, Ulsan (KR); Seung Jin Kim, Ulsan (KR)

(73) Assignee: Hyundai Heavy Industries Co., Ltd., Ulsan (KR)

( * ) Notice: Subject to any disclaimer, the term of this patent is extended or adjusted under 35 U.S.C. 154(b) by 522 days.

(21) Appl. No.: 13/816,179

(22) PCT Filed: Aug. 11, 2011

(86) PCT No.: PCT/KR2011/005879

§ 371 (c)(1),
(2), (4) Date: Apr. 22, 2013

(87) PCT Pub. No.: WO2012/020999

PCT Pub. Date: Feb. 16, 2012

(65) Prior Publication Data

US 2013/0200174 A1 Aug. 8, 2013

(30) Foreign Application Priority Data

Aug. 11, 2010 (KR) ..... 10-2010-0077396

(51) Int. Cl.

| | |
|---|---|
| ***F02M 45/08*** | (2006.01) |
| ***F02M 61/20*** | (2006.01) |
| ***F02M 43/04*** | (2006.01) |
| ***F02M 45/10*** | (2006.01) |
| ***F02M 57/02*** | (2006.01) |
| ***F02M 61/10*** | (2006.01) |

(52) U.S. Cl.

CPC ..... *F02M 45/086* (2013.01); *F02M 43/04* (2013.01); *F02M 45/10* (2013.01); *F02M 57/025* (2013.01); *F02M 61/10* (2013.01); *F02M 61/20* (2013.01); *F02M 2200/46* (2013.01)

(58) Field of Classification Search

CPC . F02M 45/086; F02M 47/022; F02M 55/008; F02M 61/042; F02M 61/20

See application file for complete search history.

(56) References Cited

U.S. PATENT DOCUMENTS 5,429,309 A 7/1995 Stockner
5,458,292 A * 10/1995 Hapeman ..... 239/533.4

(Continued)

FOREIGN PATENT DOCUMENTS

JP 06-010787 A 1/1994
JP 2006-183468 A 7/2006

(Continued)

OTHER PUBLICATIONS

PCT International Search Report and Written Opinion, PCT/KR2011/005879, Mar. 12, 2012, 8 Pages.

*Primary Examiner* — Ryan Reis
(74) *Attorney, Agent, or Firm* — Fenwick & West LLP

(57) ABSTRACT

The present invention relates to a two-stage fuel injection valve. The two-stage fuel injection valve of the present invention is configured such that the pressure of main fuel delivered from an injection pump is applied to a plunger in a main fuel chamber, and subsequently delivered to an ancillary fuel pressure chamber via the plunger so as to compress ancillary fuel, such that a needle is retracted in a manner similar to those of slide valves by means of the pressure of the ancillary fuel so as to open an ancillary fuel nozzle hole and inject the ancillary fuel, and a main fuel nozzle hole is opened after the injection of the ancillary fuel so as to inject the main fuel, thereby conducting two-stage fuel injection.

7 Claims, 17 Drawing Sheets

(56) References Cited

U.S. PATENT DOCUMENTS

2002/0070295 A1* 6/2002 Baker et al. ..... 239/533.3
2004/0055562 A1* 3/2004 Stewart et al. ..... 123/299

FOREIGN PATENT DOCUMENTS

JP 2009-275646 A 11/2009
KR 10-0299288 B1 6/2002

* cited by examiner

【Figure 14】

TWO-STAGE FUEL INJECTION VALVE

TECHNICAL FIELD

This disclosure relates to a two-stage fuel injection valve, and more particularly, to a two-stage fuel injection valve which allows a single mechanical fuel injection valve to perform a sliding-type valve opening/closing function and an auxiliary fuel compressing function simultaneously, accordingly allows one-kind two-stage fuel injection or two-stage dual fuel injection, and allows two kinds of fuels to be coaxially injected from the center of a combustion chamber.

BACKGROUND ART

As a fuel injection device of a diesel engine, a mechanical fuel injection device and an electronically controlled fuel injection device are generally used.

The mechanical fuel injection device injects a high-pressure fuel, compressed by an injection pump, into a combustion chamber through a mechanical injector. In other words, in the injection pump, a fuel is compressed by driving a plunger with a fuel cam linked to a crank shaft, and in the mechanical injector, a nozzle hole is opened or closed by sliding of a needle (or pushrod) to inject the fuel or intercept the injection of fuel. In the mechanical fuel injection device, the injection condition (injection timing, injection pressure, or injection amount) is subordinate to an engine speed. This means that pressure increases in proportion to the engine speed. Therefore, a great load is applied to the pump at every revolution. In addition, since the pressure cannot be increased over a certain engine speed, high-pressure injection is not available at a low speed. Moreover, it is difficult to optimally control the injection condition according to an operating state of an engine or a traveling state of a ship, vehicle or power generator to which the engine is mounted. Further, it is impossible to inject a fuel in multi stages, and it is also impossible to inject dual fuels.

As an improvement overcoming the drawbacks of the general mechanical fuel injection device, an electronically controlled fuel injection device using a common rail has been proposed. The electronically controlled fuel injection device includes a low-pressure pump, a high-pressure pump, a common rail and a solenoid injector. The fuel is pressurized to an ultra-high pressure while passing through the low-pressure pump and the high-pressure pump in order, and compressed with a certain pressure at the common rail by an engine control unit (ECU). In addition, the solenoid injector is governed by the ECU to adjust injection timing and injection amount. The electronically controlled fuel injection device allows high-pressure injection at a low speed since pressurization and injection are separately performed. In addition, since the injection condition may be freely controlled according to an operating condition, engine performance (e.g., output) and fuel efficiency may be improved. Moreover, by controlling the solenoid injector, multi-stage injection such as pilot injection, main injection and post injection may be performed, which improves fuel efficiency and reduces discharge gas. However, the electronically controlled fuel injection device is not able to inject dual fuels and thus not useable for a dual fuel engine.

A duel or two-kind fuel engine has two combustion modes. For example, in a diesel fuel mode, before a main fuel (e.g., heavy fuel oil, marine diesel oil) is injected, an auxiliary fuel (e.g., marine diesel oil, marine gas oil) may be injected to improve a combustion environment of the combustion chamber, resulting in improvement of exhaust, NOx and combustion performance. In addition, in a gas fuel mode, only an auxiliary fuel may be injected by adjusting a fuel injection amount governor so that a gas fuel flowing in through a gas admission valve and an engine intake port may be stably ignited.

In order to inject dual fuels by using the mechanical fuel injection device or the electronically controlled fuel injection device, described above, another injector should be added, which complicates the system and greatly increases costs.

For example, a general fuel injection device shown in FIG. 17 uses a parallel twin injector to inject dual fuels. The twin injector is configured to inject different kinds of fuels by combining a single general mechanical injector and a single solenoid injector. However, since two fuel injection lines are arranged in a single injector body, the injection device has an increased size and occupies a greater space. In addition, two nozzle orifices and shafts corresponding to the dual fuels are installed in parallel at spaced points. For this reason, one of two kinds of fuels is inevitably injected at a location deviating from the center of the combustion chamber, which makes it difficult to optimize the fuel performance. Moreover, when a main fuel containing a large amount of particles (a heavy fuel oil) is injected, the auxiliary fuel nozzle orifice may be closed. Further, since a common rail, a high-pressure pump and a solenoid injector should be additionally installed for auxiliary injection, the system becomes more expensive and complicated.

In addition, as another example, for two-stage dual-fuel injection, in addition to an existing mechanical main injector disposed at the center of the combustion chamber, an electronically controlled auxiliary injector separately prepared may be installed with a slope around the main injector. However, in this case, the auxiliary injection is not performed at the center of the cylinder head but performed aside, and the injection direction (angle) is also inclined to one side, which results in bad fuel performance.

DISCLOSURE

Technical Problem

The present disclosure is directed to providing a two-stage fuel injection valve, which allows two-stage fuel injection and dual fuel injection by using a single mechanical injector, thereby improving combustion performance and reducing exhaust gas at the lowest cost.

The present disclosure is also directed to selectively opening or closing a main nozzle hole and an auxiliary nozzle hole by using a single mechanical fuel injection valve and simultaneously performing an auxiliary fuel compressing function, with a simple structure and without a separate compression pump for compressing the auxiliary fuel.

The present disclosure is also directed to improving combustion performance by allowing two kinds of fuels to be coaxially injected at the center of the combustion chamber.

Technical Solution

In one general aspect, there is provided a two-stage fuel injection valve for injecting a fuel into a combustion chamber of a cylinder head, which includes: a valve body having a plurality of main fuel nozzle holes and a plurality of auxiliary fuel nozzle holes radially formed at points axially spaced apart from the front end based on the same center axis, a main fuel inflow passage formed from a main fuel inlet to a point adjacent to the main fuel nozzle hole, a first main fuel chamber axially formed to communicate with the main fuel inflow passage, an auxiliary fuel inflow passage formed from an auxiliary fuel inlet to a point adjacent to the auxiliary fuel nozzle hole, and an auxiliary fuel discharge passage formed from another point adjacent to the auxiliary fuel nozzle hole; a plunger inserted into the first main fuel chamber of the valve body to be axially slidable so that an auxiliary fuel pressurizing chamber is formed between the front end and the valve body to communicate with the auxiliary fuel nozzle hole, advancing forwards with the pressure of a main fuel applied to the first main fuel chamber to pressurize an auxiliary fuel in the auxiliary fuel pressurizing chamber, and allowing the main fuel inflow passage to communicate with the main fuel nozzle hole after an auxiliary fuel injection completion point; a plunger spring for elastically pressurizing the plunger in a retreating direction; a needle inserted into the center of the plunger to be slidable in an axial direction, the needle having a needle end at the front end thereof to close the auxiliary fuel nozzle hole, the needle retreating by means of pressure increase of the auxiliary fuel pressurizing chamber so that the auxiliary fuel pressurizing chamber communicates with the auxiliary fuel nozzle hole; and a needle spring interposed between the rear end of the needle and the plunger to elastically pressurize the needle in the advancing direction.

A second main fuel chamber communicating with a terminal of the main fuel inflow passage may be formed along the outer circumference of the front end of the plunger in a groove shape, the main fuel nozzle hole may be closed when the plunger retreats, and the main fuel inflow passage may communicate with the main fuel nozzle hole when plunger advances forwards.

In addition, an auxiliary fuel inflow chamber communicating with a terminal of the auxiliary fuel inflow passage and an auxiliary fuel discharge chamber communicating with a terminal of the auxiliary fuel discharge passage may be formed at the outer circumference of the plunger, and a first elongated groove connecting the auxiliary fuel inflow chamber to the auxiliary fuel pressurizing chamber and a second elongated groove for connecting the auxiliary fuel pressurizing chamber to the auxiliary fuel discharge chamber may be formed at the outer circumference of the needle. The first elongated groove and the second elongated groove may communicate with the auxiliary fuel pressurizing chamber or be closed by means of retreat or advance of the plunger.

In this case, the auxiliary fuel inflow chamber may have a groove formed along the outer circumference of the plunger, and a communication hole connecting the groove to the first elongated groove of the needle, and the auxiliary fuel discharge chamber may have a groove formed along the outer circumference of the plunger, and a communication hole connecting the groove to the second elongated groove of the needle.

The valve body may be configured as an assembly of a plurality of divided bodies divided in an axial direction.

In this case, the valve body may include: a base body having a main fuel inlet, a first main fuel inflow passage, an auxiliary fuel inlet and a first auxiliary fuel inflow passage; and a nozzle body having the first main fuel chamber, the main fuel nozzle hole and the auxiliary fuel nozzle hole and assembled to the base body in an axial direction, the nozzle body having a second main fuel inflow passage connected to the first main fuel inflow passage and a second auxiliary fuel inflow passage connecting the first auxiliary fuel inflow passage to the auxiliary fuel pressurizing chamber.

Meanwhile, the valve body may be configured as an assembly where a first body, a second body and a third body are coupled in an axial direction from the rear end toward the front end, and a holder may be coupled to the front end of the first body to surround and fix the second body and the third body.

Advantageous Effects

The two-stage fuel injection valve of the present disclosure transfers the pressure of a main fuel carried by pressure from an injection pump to an auxiliary fuel pressurizing chamber by means of a plunger, thereby pressurizing the auxiliary fuel. Due to the pressurization of the auxiliary fuel, a needle is operated in a slide valve manner, thereby injecting the auxiliary fuel. After the auxiliary fuel is injected, the main fuel nozzle hole is opened to inject the main fuel, thereby performing two-stage fuel injection. In addition, by dually disposing main and auxiliary fuel passages and nozzle holes in a single body, dual fuels may be injected simultaneously.

Therefore, according to the present disclosure, two-stage fuel injection and dual fuel injection may be performed by using a single mechanical injector, with a simple structure.

In addition, the main nozzle hole and the auxiliary nozzle hole may be selectively opened or closed by using a single mechanical fuel injection valve, and the auxiliary fuel may be compressed by means of the pressure received from the main fuel. Therefore, the auxiliary fuel may be compressed with a simple structure, and a separate injection pump is not needed to compress the auxiliary fuel.

Moreover, since two kinds of fuels are coaxially injected in a radial direction at the center of the combustion chamber, the fuel performance may be improved.

BEST MODE

Hereinafter, an embodiment of the present disclosure will be described in detail with reference to the accompanying drawings.

Figure 1:
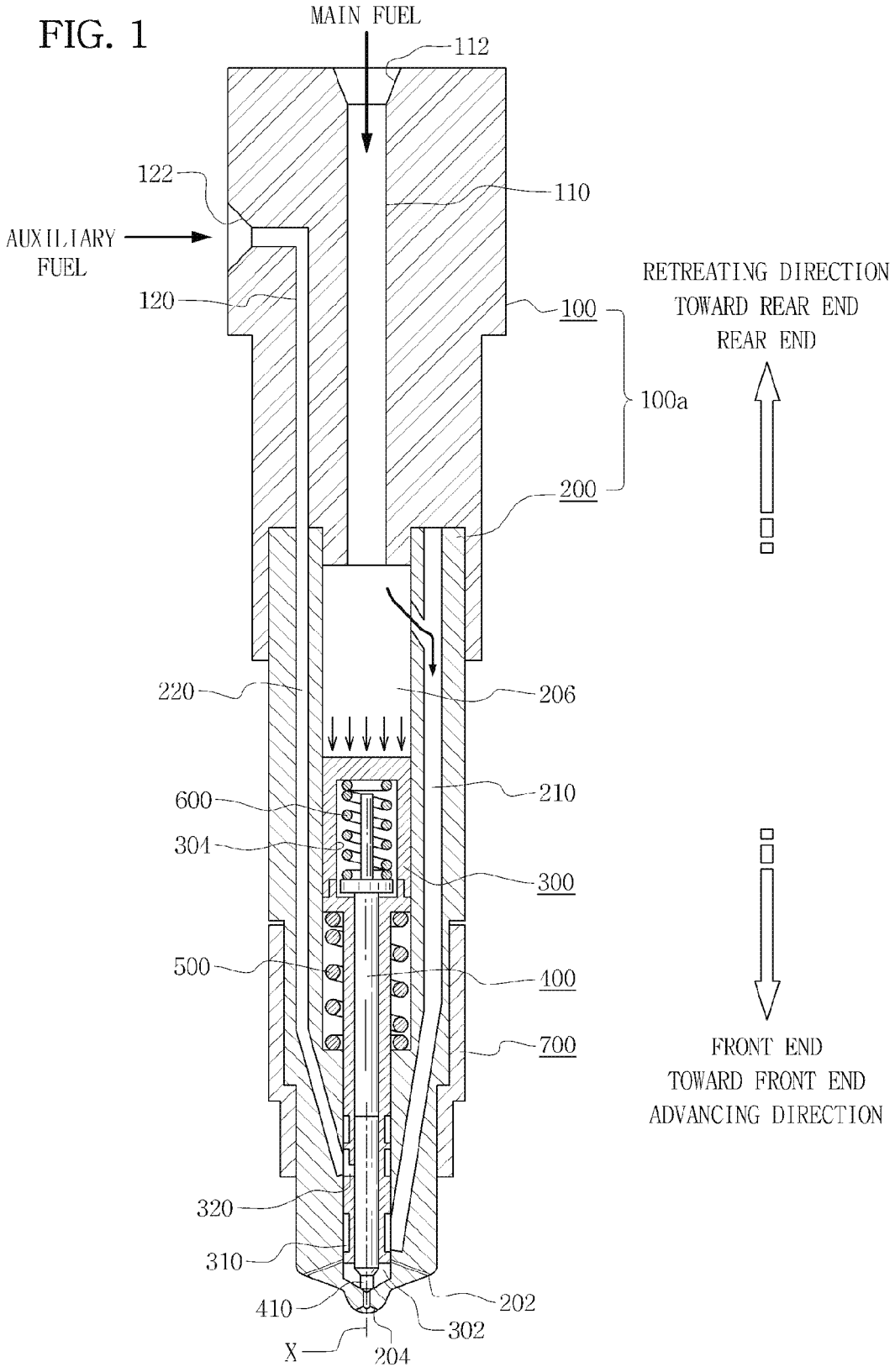
FIG. 1 is a cross-sectional view showing a two-stage fuel injection valve according to the present disclosure.
Figure 2:
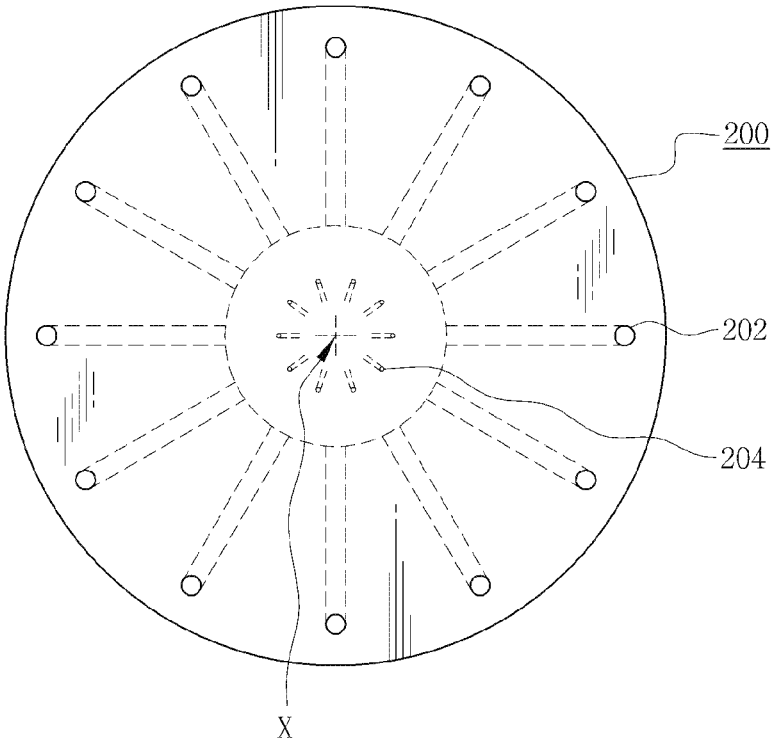
FIG. 2 is a bottom view of FIG. 1 and shows dispositions of a main nozzle hole and an auxiliary nozzle hole.

FIGS. 1 and 2 show a two-stage fuel injection valve according the present disclosure, where FIG. 1 is a cross-sectional view and FIG. 2 is a bottom view of FIG. 2.

As shown in FIGS. 1 and 2, the two-stage fuel injection valve of the present disclosure includes a valve body 100*a* (also referred to as "an injector body") at the front end thereof (the lower end portion in FIG. 1) where a main fuel nozzle hole 202 and an auxiliary fuel nozzle hole 204 are formed.

The main fuel nozzle hole 202 and the auxiliary fuel nozzle hole 204 are radially formed based on the same central axis at points axially spaced apart from each other. Therefore, two kinds of fuels may be coaxially injected in a radial direction at the center portion of a combustion chamber to enhance combustion performance.

At the valve body 100*a*, a main fuel inlet 112 and an auxiliary fuel inlet 122 are formed. A main fuel inflow passage 110, 210 is formed from the main fuel inlet 112 to a point adjacent to the main fuel nozzle hole 202. A first main fuel chamber 206 communicating with the main fuel inflow passage 110, 210 is axially formed in the middle of the main fuel inflow passage 110, 210. In addition, an auxiliary fuel inflow passage 120, 220 is formed from the auxiliary fuel inlet 122 to a point adjacent to the auxiliary fuel nozzle hole 204. An auxiliary fuel discharge passage 230 (see FIG. 7) is formed at another point adjacent to the auxiliary fuel nozzle hole 204.

A plunger 300 is inserted into the first main fuel chamber 206 of the valve body 100*a* to be slidable in an axial direction. The first main fuel chamber 206 at the rear end of the plunger 300 plays a role of a so-called 'pressure cylinder' to which the pressure of a main fuel is applied. An auxiliary fuel pressurizing chamber 302 communicating with the auxiliary fuel nozzle hole 204 is formed at the front end of the plunger 300. Therefore, if the pressure of the main fuel (the pressure from the injection pump) applied to the first main fuel chamber 206 is applied to the rear end of the plunger 300, the plunger 300 advances forwards to pressurize an auxiliary fuel received in the auxiliary fuel pressurizing chamber 302. In other words, the plunger 300 plays a role of an injection pump or fuel pump which pressurizes the auxiliary fuel. Therefore, there is no need of a separate device for pressurizing the auxiliary fuel. After the pressurized auxiliary fuel is completely injected through the auxiliary fuel nozzle hole 204, the plunger 300 allows the main fuel inflow passage 110, 210 to communicate with the main fuel nozzle hole 202 so that the main fuel is injected.

A plunger 300 is elastically pressurized by a plunger spring 500 in a retreating direction (rearwards). The plunger spring 500 resists against the pressure applied to the first main fuel chamber 206. If the pressure applied to the first main fuel chamber 206 is greater than a restoring force of the plunger spring 500, the plunger 300 advances toward the front end. On the contrary, if the restoring force of the plunger spring 500 is greater than the pressure applied to the first main fuel chamber 206, the plunger 300 retreats toward the rear end.

A needle 400 is inserted into the plunger 300 to be slidable in an axial direction. The plunger 300 has a needle end 410 at the front end thereof to close the auxiliary fuel nozzle hole 204. If the needle 400 retreats with the pressure received from the auxiliary fuel pressurizing chamber 302, the auxiliary fuel nozzle hole 204 opens so that the auxiliary fuel in the auxiliary fuel pressurizing chamber 302 is injected.

The needle 400 is elastically pressurized in the advancing direction by the needle spring 600. In other words, the needle spring 600 elastically pressurizes the needle 400 in a direction of closing the auxiliary fuel nozzle hole 204 against the pressure of the auxiliary fuel pressurizing chamber 302. If the pressure of the auxiliary fuel in the auxiliary fuel pressurizing chamber 302 increases by the plunger 300 over the elastic pressurizing force of the needle spring 600, the needle 400 retreats.

The valve body 100*a* may be configured as an assembly of a plurality of divided bodies divided in an axial direction. This helps easier processing of the valve body 100*a* and easier assembling of parts. In the embodiment depicted in FIG. 1, the valve body 100*a* is divided into two bodies, namely the base body 100 and the nozzle body 200 which are coupled in the axial direction. It is not obligated that the valve body 100*a* is divided into two bodies as shown in FIG. 1, and the valve body 100*a* may also be separately manufactured as three or more bodies and then coupled. In addition, the size, length, split fraction or the like of the divided bodies (for example, the base body 100 and the nozzle body 200) are not important. They may be freely designed as long as processing, assembling and mechanical operation are satisfactorily ensured.

Since the valve body 100*a* is divided into two bodies, namely the base body 100 and the nozzle body 200, the main fuel inflow passage system and the auxiliary fuel inflow passage system are also fabricated in parts and then assembled and communicated. In other words, the main fuel inlet 112, the first main fuel inflow passage 110, the auxiliary fuel inlet 122 and the first auxiliary fuel inflow passage 120 are formed at the base body 100. The first main fuel chamber 206, the main fuel nozzle hole 202 and the auxiliary fuel nozzle hole 204 are formed at the nozzle body 200, and the second main fuel inflow passage 210 and the second auxiliary fuel inflow passage 220 are also formed.

Figure 3:
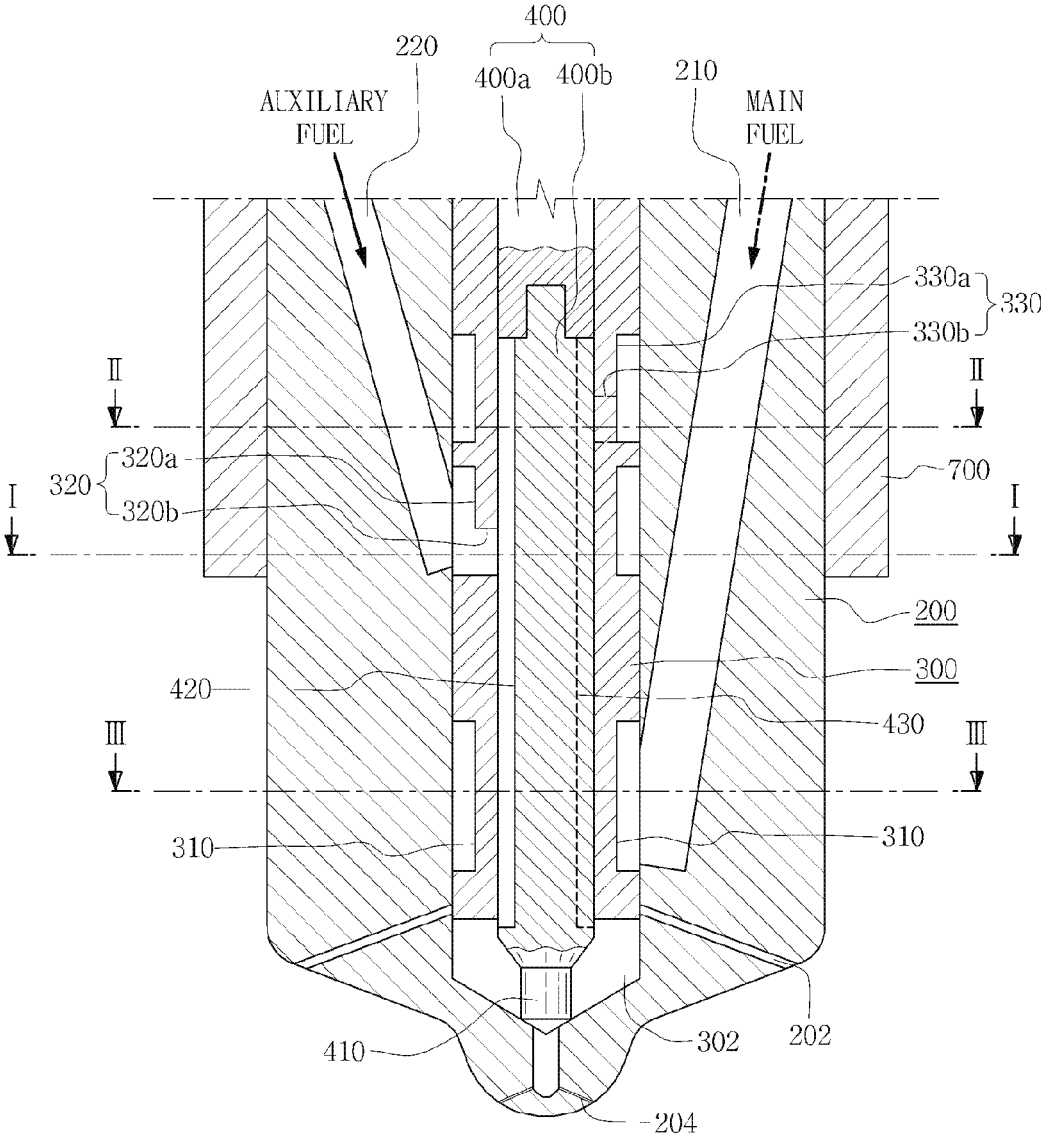
FIG. 3 is an enlarged view showing a head portion of the two-stage fuel injection valve of FIG. 1.
Figure 4:
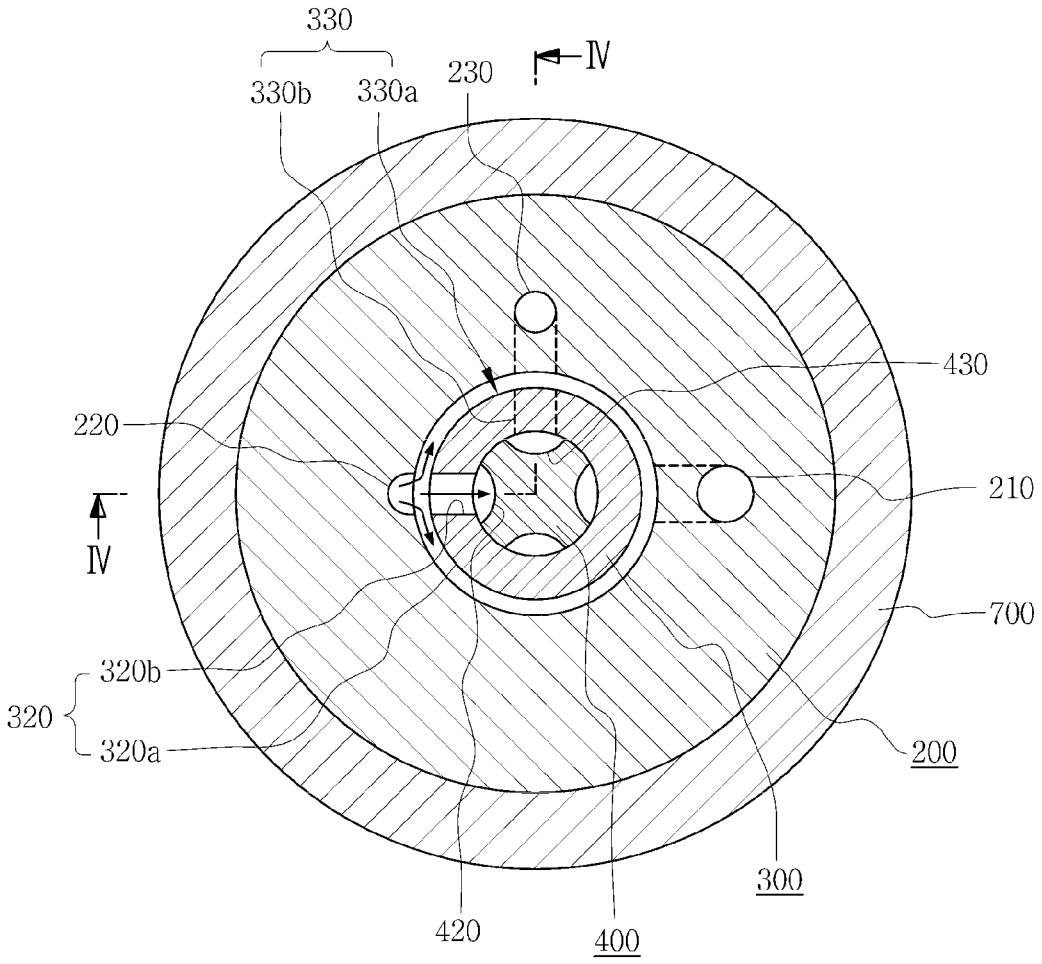
FIG. 4 is a cross-sectional view taken along the line I-I of FIG. 3.
Figure 5:
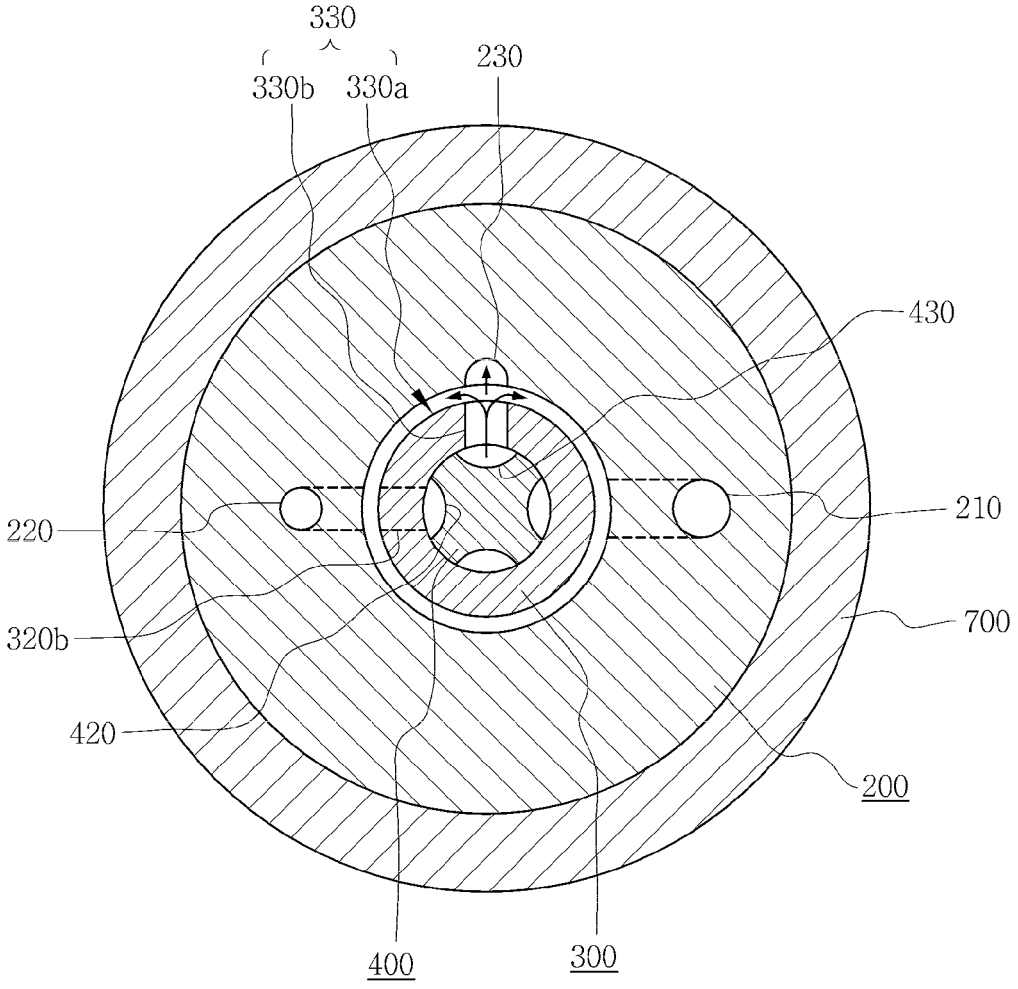
FIG. 5 is a cross-sectional view taken along the line II-II of FIG. 3.
Figure 6:
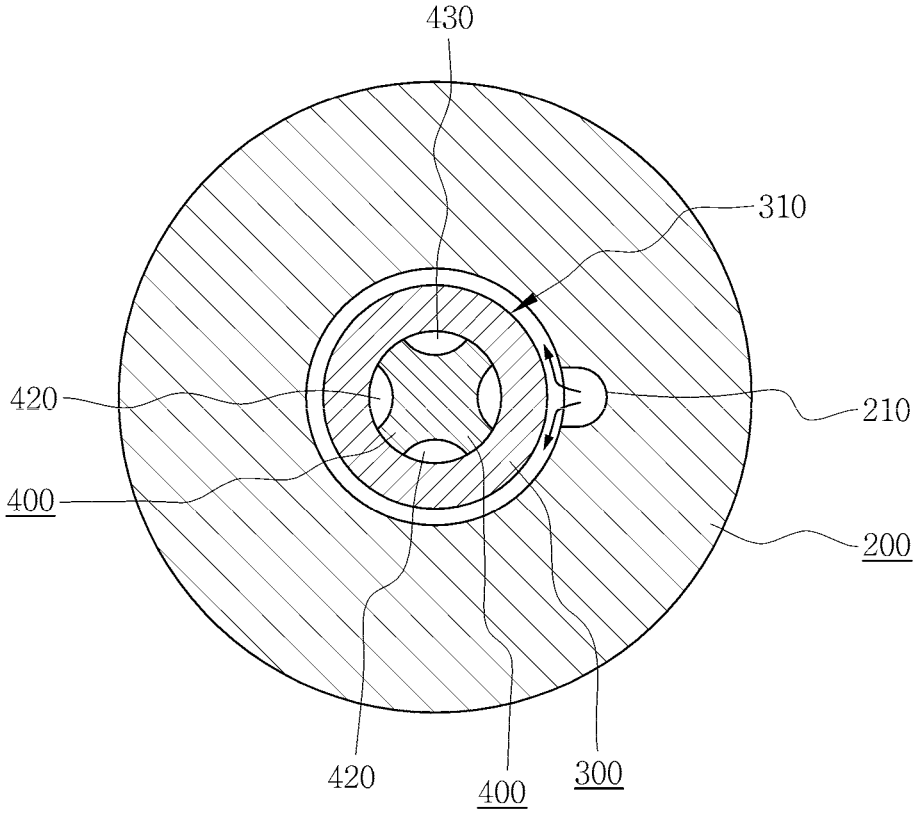
FIG. 6 is a cross-sectional view taken along the line III-III of FIG. 3.
Figure 7:
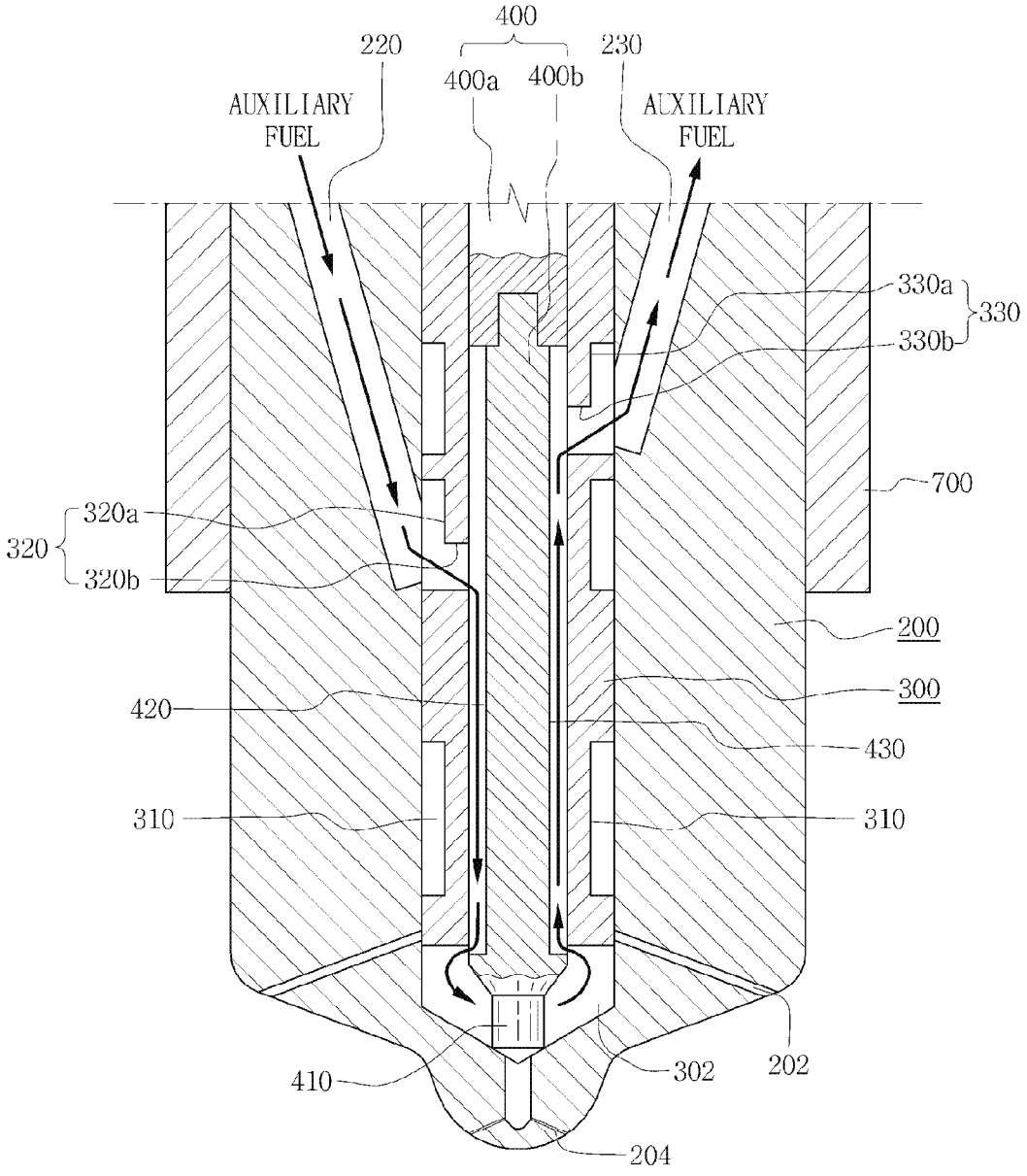
FIG. 7 is a cross-sectional view taken along the line IV-IV of FIG. 4 and shows an opening state of an auxiliary fuel circulation line before the fuel injection valve initiates a fuel injecting operation.

FIG. 3 is an enlarged view showing a head portion of the two-stage fuel injection valve of FIG. 1, FIG. 4 is a cross-sectional view taken along the line I-I of FIG. 3, FIG. 5 is a cross-sectional view taken along the line II-II of FIG. 3, FIG. 6 is a cross-sectional view taken along the line III-III of FIG. 3, and FIG. 7 is a cross-sectional view taken along the line IV-IV of FIG. 4.

As shown in the enlarged view of FIG. 3 and as described above, the main fuel nozzle hole 202 and the auxiliary fuel nozzle hole 204 are formed at the front end of the nozzle body 200. In addition, the space between the front end of the plunger 300 and the nozzle body 200 forms the auxiliary fuel pressurizing chamber 302. The needle 400 is inserted into the plunger 300, and the front end portion of the needle 400 is inserted into the auxiliary fuel pressurizing chamber 302 and closes the auxiliary fuel nozzle hole 204 by means of the needle end 410 thereof. The needle 400 is divided into two bodies, namely a first needle body 400*a* and a second needle body 400*b*, which are axially coupled, for the convenient manufacture.

In addition, a second main fuel chamber 310 communicating with a terminal of the main fuel inflow passage 110, 210 is formed along the outer circumference of the front end of the plunger 300. When the plunger 300 retreats, the main fuel nozzle hole 202 is closed. If the plunger 300 advances forwards, the main fuel inflow passage 110, 210 and the main fuel nozzle hole 202 are connected to each other within the second main fuel chamber 310 so that the main fuel is injected.

In addition, an auxiliary fuel inflow chamber 320 communicating with a terminal of the auxiliary fuel inflow passage 120, 220 and an auxiliary fuel discharge chamber 330 communicating with a terminal of the auxiliary fuel discharge passage 230 (see FIG. 7) are formed at the circumference of the center portion of the plunger 300.

Moreover, a first elongated groove 420 and a second elongated groove 430 are formed at the outer circumference of the needle 400. The first elongated groove 420 plays a role of connecting the auxiliary fuel inflow chamber 320 to the auxiliary fuel pressurizing chamber 302. The second elongated groove 430 plays a role of connecting the auxiliary fuel pressurizing chamber 302 to the auxiliary fuel discharge chamber 330. The first elongated groove 420 and the second elongated groove 430 communicate with the auxiliary fuel pressurizing chamber 302 or are closed according to retreat or advance of the plunger 300.

As shown in FIGS. 3 and 4, the auxiliary fuel inflow chamber 320 has a groove 320*a* formed along the outer circumference of the plunger 300, and a communication hole 320*b* connecting the groove 320*a* to the first elongated groove 420 of the needle 400. Therefore, the auxiliary fuel flowing in through the auxiliary fuel inflow passage 120, 220 fills the groove 320*a* formed at the outer circumference of the plunger 300, then flows into the first elongated groove 420 through the communication hole 320*b*, and flows into the auxiliary fuel pressurizing chamber 302 at the second elongated groove 430.

In addition, as shown in FIGS. 3 and 5, the auxiliary fuel discharge chamber 330 has a groove 330*a* formed along the outer circumference of the plunger 300, and a communication hole 330*b* connecting the groove 330*a* to the second elongated groove 430 of the needle 400. Therefore, the auxiliary fuel flowing into the auxiliary fuel pressurizing chamber 302 flows out along the second elongated groove 430, then passes through the communication hole 330*b* and the groove 330*a*, and discharges out through the auxiliary fuel discharge passage 230.

Next, as shown in FIGS. 3 and 6 and as described above, the second main fuel chamber 310 is formed with a groove shape along the outer circumference of the front end of the plunger 300. The main fuel flowing in through the main fuel inflow passage 110, 210 stays at the circumference of the second main fuel chamber 310, and then if the plunger 300 advances forwards, the plunger 300 encounters the main fuel nozzle hole 202 so that the main fuel is injected.

The two-stage fuel injection valve of the present disclosure configured as above allows two-stage fuel injection by transferring the pressure of the main fuel carried by pressure from the injection pump to the auxiliary fuel pressurizing chamber 302 by means of the plunger 300 so that the auxiliary fuel is pressurized, operating the needle 400 in a slide valve manner by the pressurization of the auxiliary fuel so that the auxiliary fuel is injected, and opening the main fuel nozzle hole 202 after the injection of the auxiliary fuel so that the main fuel is injected. In addition, dual fuels may be injected by dually disposing main and auxiliary fuel passages and nozzle holes.

Hereinafter, a fuel injecting operation of the fuel injection valve according to the present disclosure will be described in detail with reference to FIGS. 7 to 12.

FIG. 7 is a cross-sectional view taken along the line IV-IV of FIG. 4 and shows an opening state of an auxiliary fuel circulation line before the fuel injection valve initiates a fuel injecting operation. Before fuel injection is initiated, the auxiliary fuel system maintains a circulating state by means of the plunger 300 and the needle 400, and the main fuel system is blocked. In other words, the end 410 of the needle 400 closes the auxiliary fuel nozzle hole 204, and the front end surface of the plunger 300 are deviated from the first elongated groove 420 and the second elongated groove 430 of the needle 400. Therefore, the auxiliary fuel flowing into the auxiliary fuel pressurizing chamber 302 through the auxiliary fuel inflow passage 220, the auxiliary fuel inflow chamber 320 and the first elongated groove 420 flows out to the second elongated groove 430 and discharges through the auxiliary fuel discharge chamber 330 and the auxiliary fuel discharge passage 230. Due to the circulation of the auxiliary fuel, the nozzle is cooled, and the thermal load and carbon deposit of the nozzle are improved.

Figure 8:
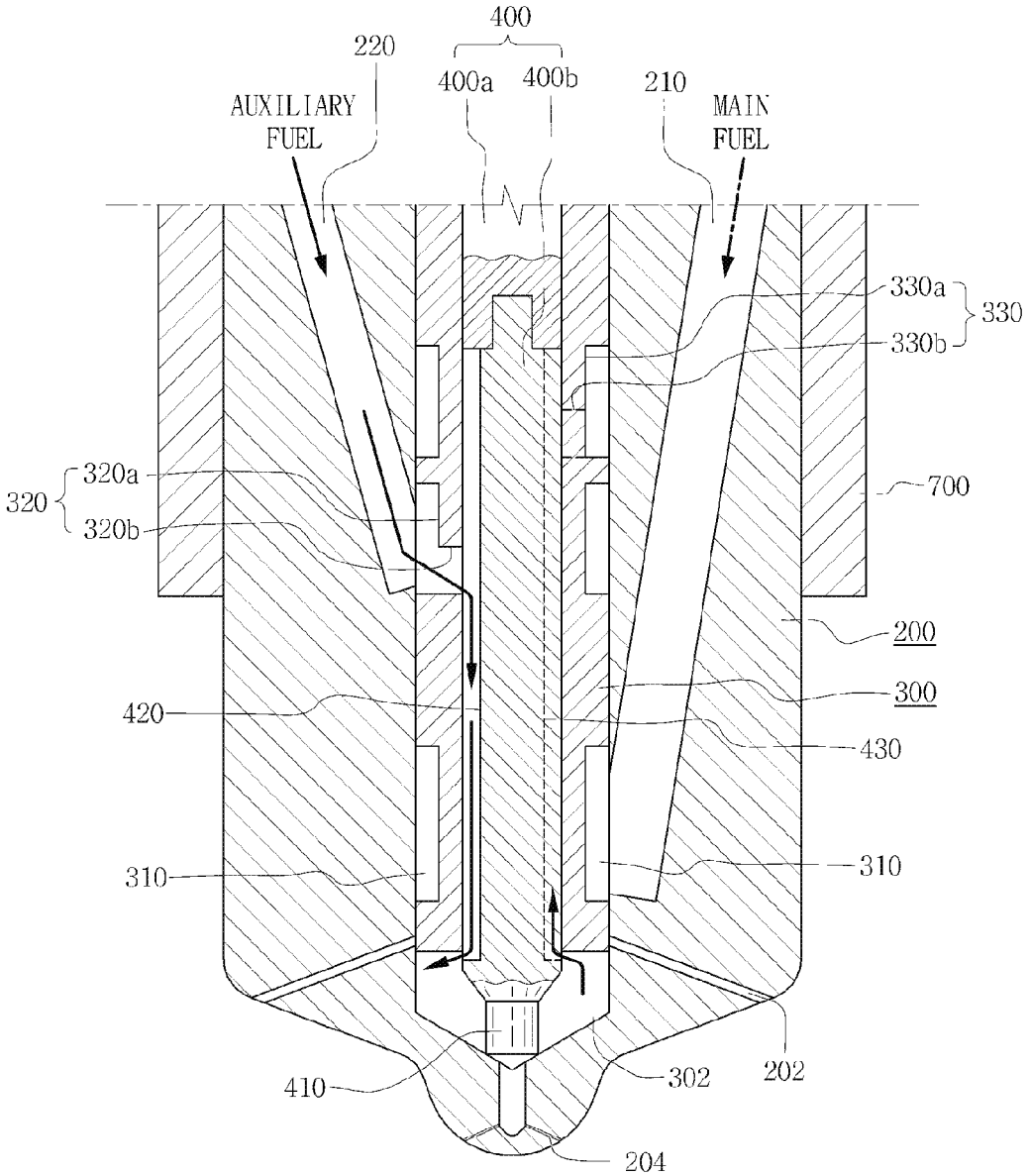
FIG. 8 is a diagram showing a state before the two-stage fuel injection valve according to the present disclosure initiates the fuel injecting operation.

FIG. 8 is a diagram showing a state before the two-stage fuel injection valve of FIG. 7 initiates the fuel injecting operation. The main fuel nozzle hole 202 is closed by the plunger 300. Therefore, the main fuel flowing in through the main fuel inflow passage 210 stays in the second main fuel chamber 310.

Referring to FIG. 1 again, if the main fuel is carried by pressure from the main fuel injection pump in a state of FIGS. 7 and 8, the main fuel fills the main fuel inlet 112 of the valve body 100*a*, the main fuel inflow passage 110, 210 and the first main fuel chamber 206. The pressure of the main fuel pressurized by the injection pump is applied to the rear end (the upper end surface in the figure) of the plunger 300 at the first main fuel chamber 206. In addition, if the pressure of the main fuel applied to the plunger 300 exceeds the elastic force of the plunger spring 500, the plunger 300 advances forwards while compressing the plunger spring 500.

Figure 9:
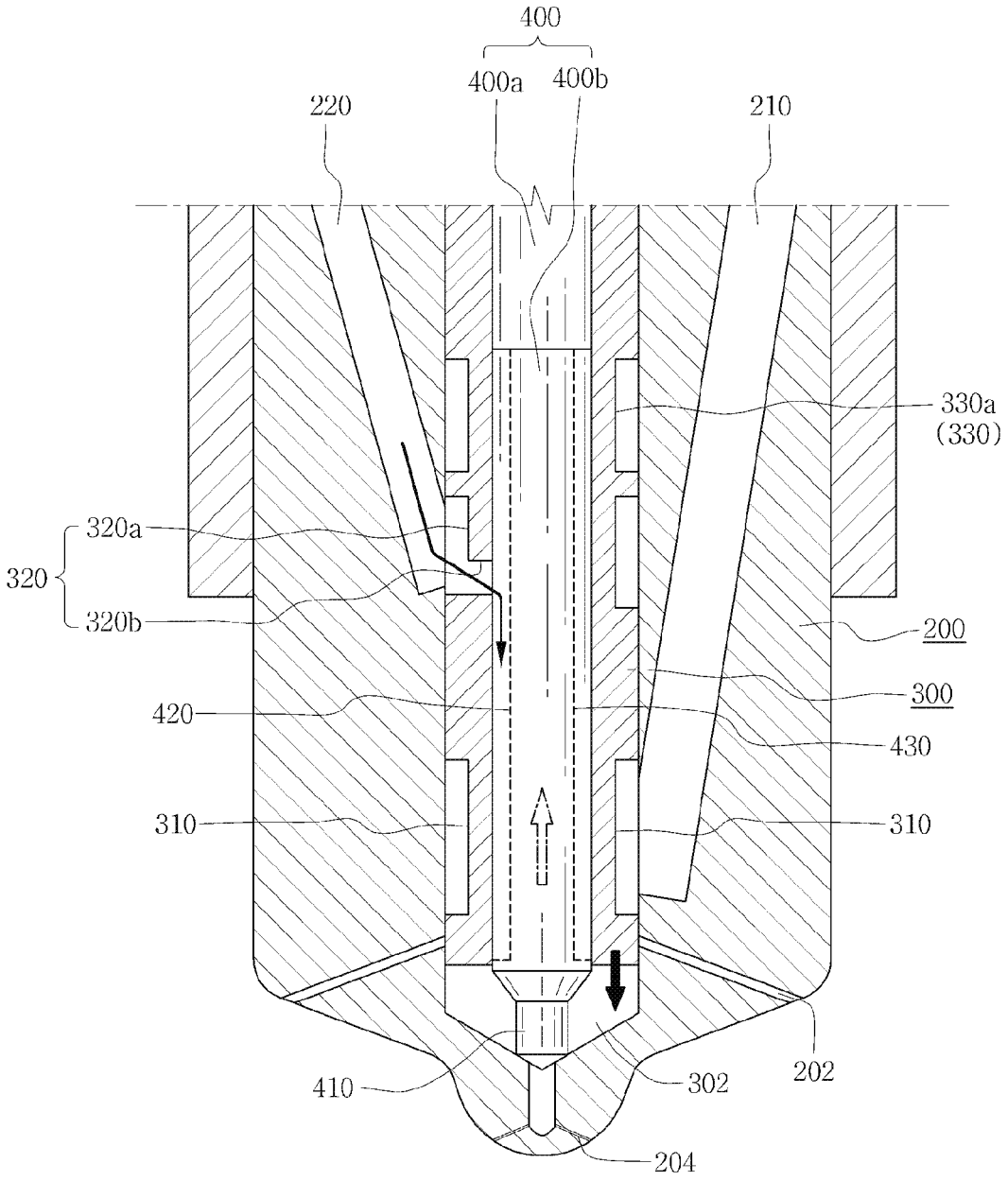
FIG. 9 is a diagram showing an initial state when an auxiliary fuel starts being compressed by means of the pressure of the main fuel, after the state of FIG. 8.

FIG. 9 shows a state where the plunger 300 advances slightly through the above procedure. If the plunger 300 advances forwards by the pressure of the main fuel applied at the first main fuel chamber 206 so that the front end surface thereof passes by the first and second elongated grooves 420, 430 of the needle 400, the auxiliary fuel circulation line is intercepted, and the auxiliary fuel in the auxiliary fuel pressurizing chamber 302 is pressurized. The pressurization force of the auxiliary fuel is applied to the needle 400. If the pressurization force of the auxiliary fuel caused by the advancing movement of the plunger 300 exceeds the elastic force of the needle spring 600 (see FIG. 1), the needle 400 retreats.

Figure 10:
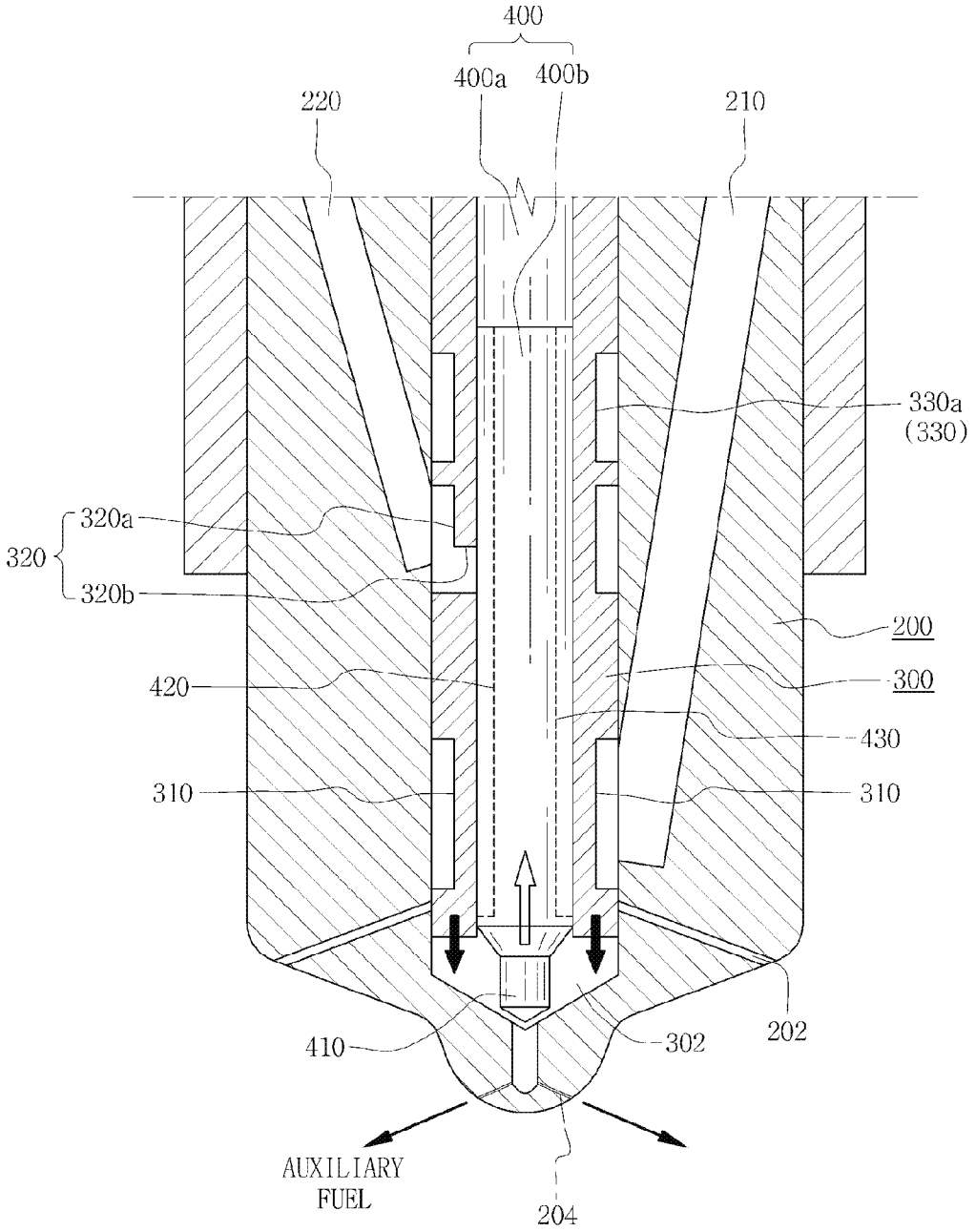
FIG. 10 is a diagram showing a state where the auxiliary fuel is being injected, after the state of FIG. 9.

FIG. 10 shows a state where the needle 400 retreats. If the needle 400 retreats, the needle end 410 moves back and opens the auxiliary fuel nozzle hole 204, thereby injecting the auxiliary fuel. In proportion to the injection of the auxiliary fuel, the pressure of the auxiliary fuel pressurizing chamber 302 is lowered. If the pressure of the auxiliary fuel pressurizing chamber 302 is lowered than the restoring force of the needle spring 600, the needle 400 advances again to close the auxiliary fuel nozzle hole 204.

Figure 11:
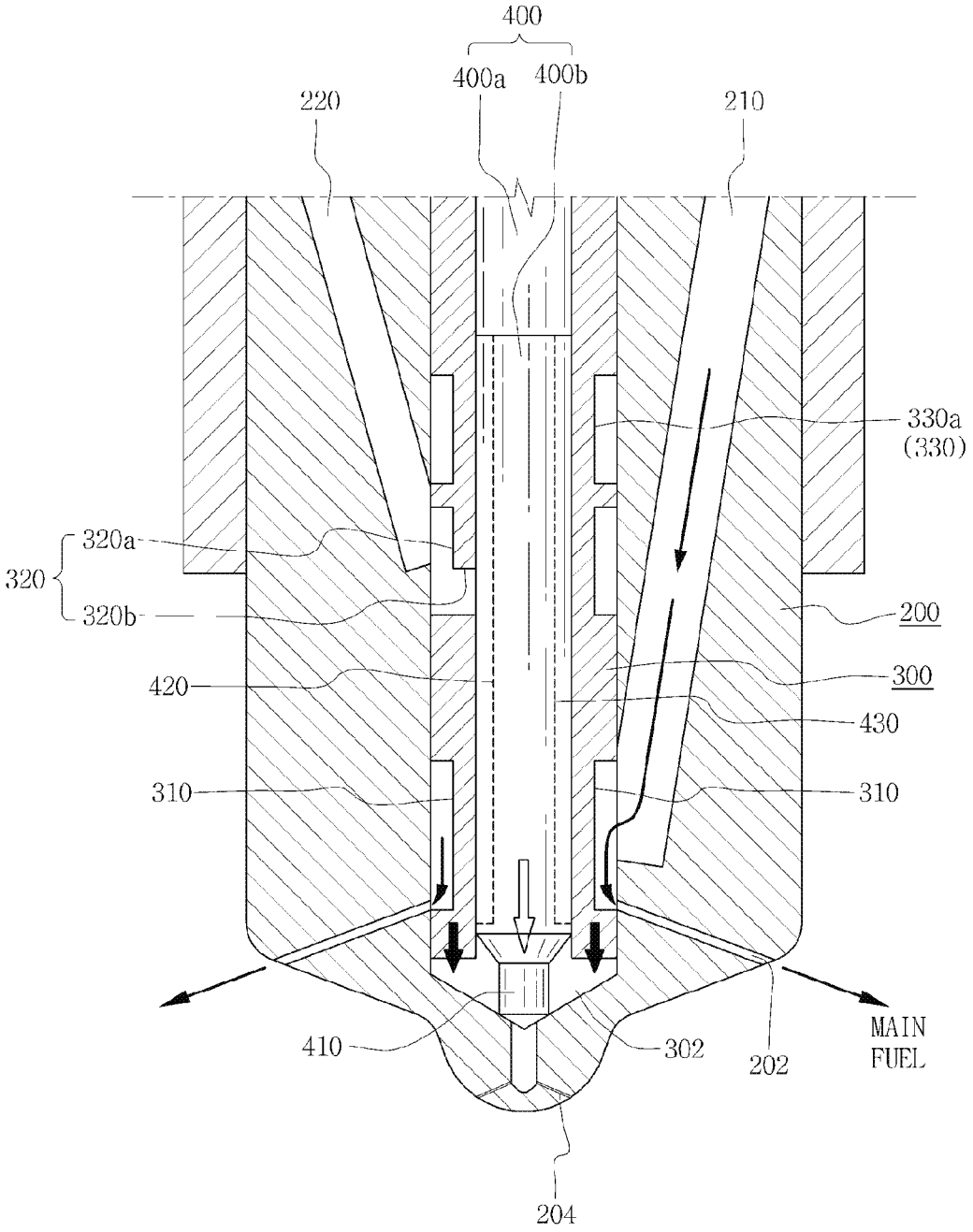
FIG. 11 is a diagram showing a state where the auxiliary fuel is blocked and the main fuel is injected, after the state of FIG. 10.

FIG. 11 shows this state. In other words, when the pressure of the auxiliary fuel pressurizing chamber 302 is lowered and the needle 400 advances forwards, the plunger 300 also advances continuously. As soon as the needle 400 advances and closes the auxiliary fuel nozzle hole 204, the second main fuel chamber 310 encounters the main fuel nozzle hole 202 due to the advancing movement of the plunger 300, thereby injecting the main fuel to the combustion chamber.

Figure 12:
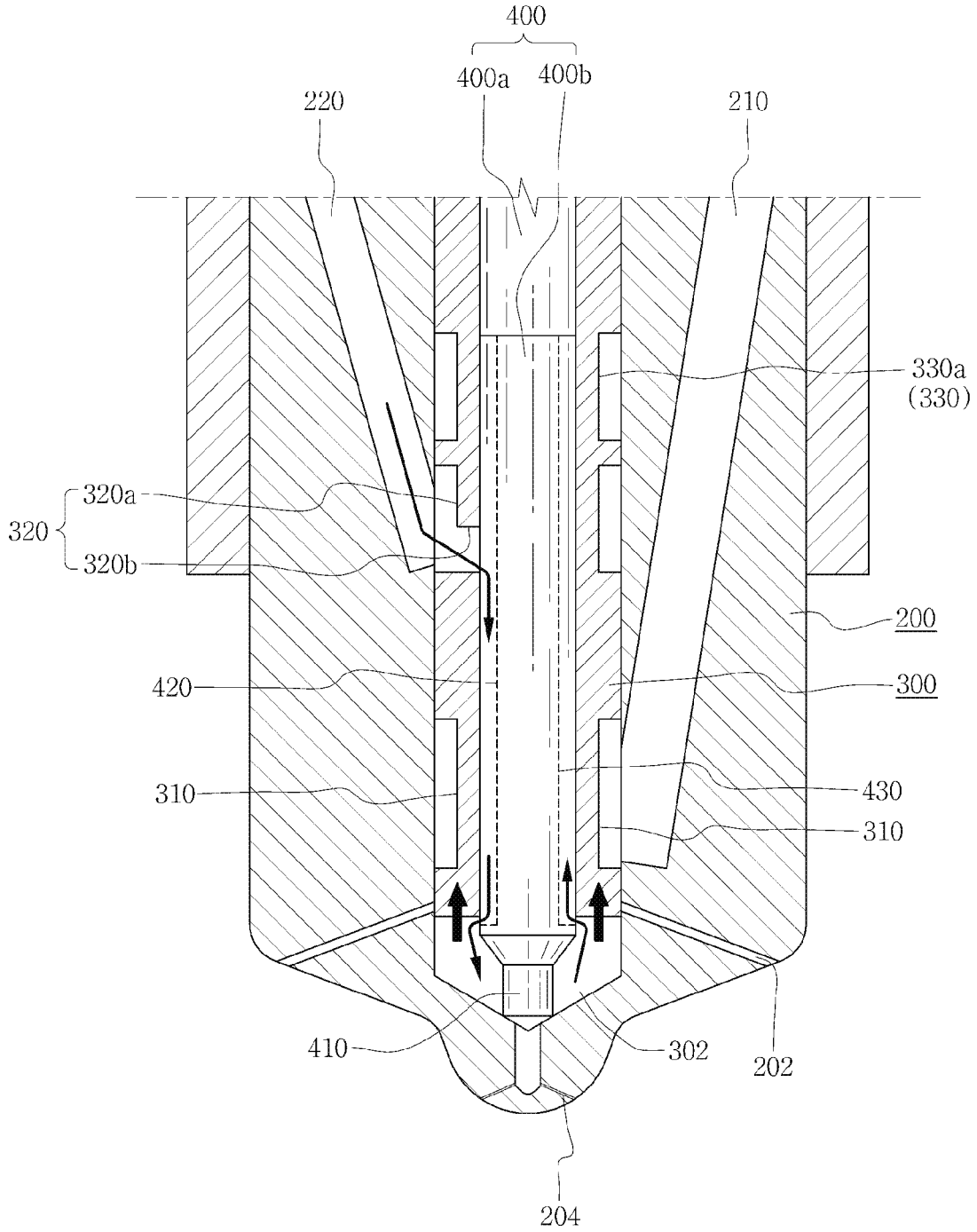
FIG. 12 is a diagram showing a state where the main fuel is completely injected.

FIG. 12 shows a state where the main fuel is completely injected. At the point where the pressurizing action of the injection pump ends, the injection of the main fuel terminates. If the pressure of the first main fuel chamber 206 is lowered due to the end of the pressurizing action of the injection pump and the termination of the main fuel injection, the plunger 300 returns (retreats). Due to the retreat of the plunger 300, the main fuel nozzle hole 202 is closed again and the auxiliary fuel pressurizing chamber 302 is opened again, which returns to the state before the injection was initiated.

Figure 13:
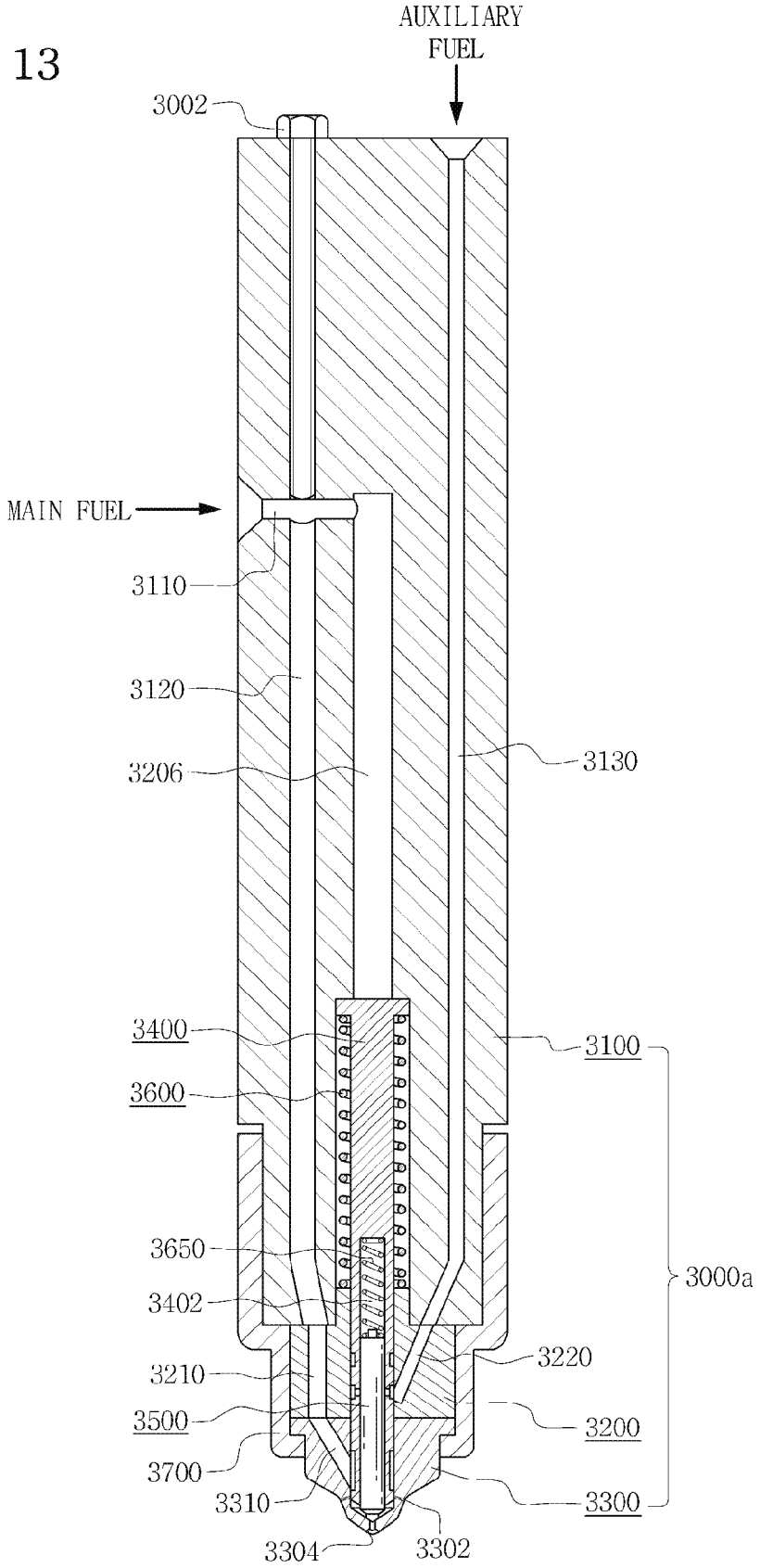
FIG. 13 is a diagram showing a structure of a two-stage fuel injection valve according to another embodiment of the present disclosure.
Figure 14:
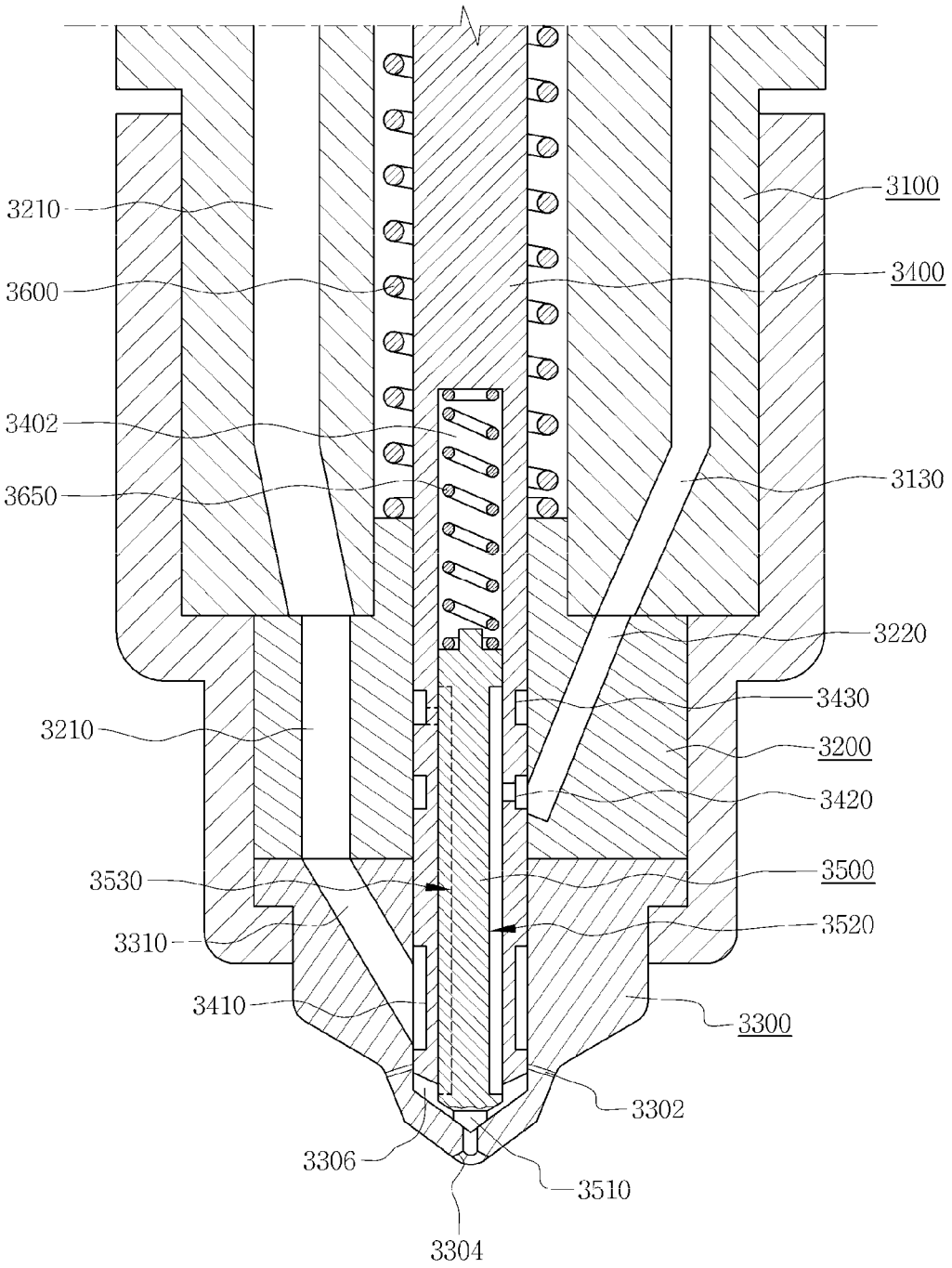
FIG. 14 is an enlarged view showing a head portion of FIG. 13.
Figure 15:
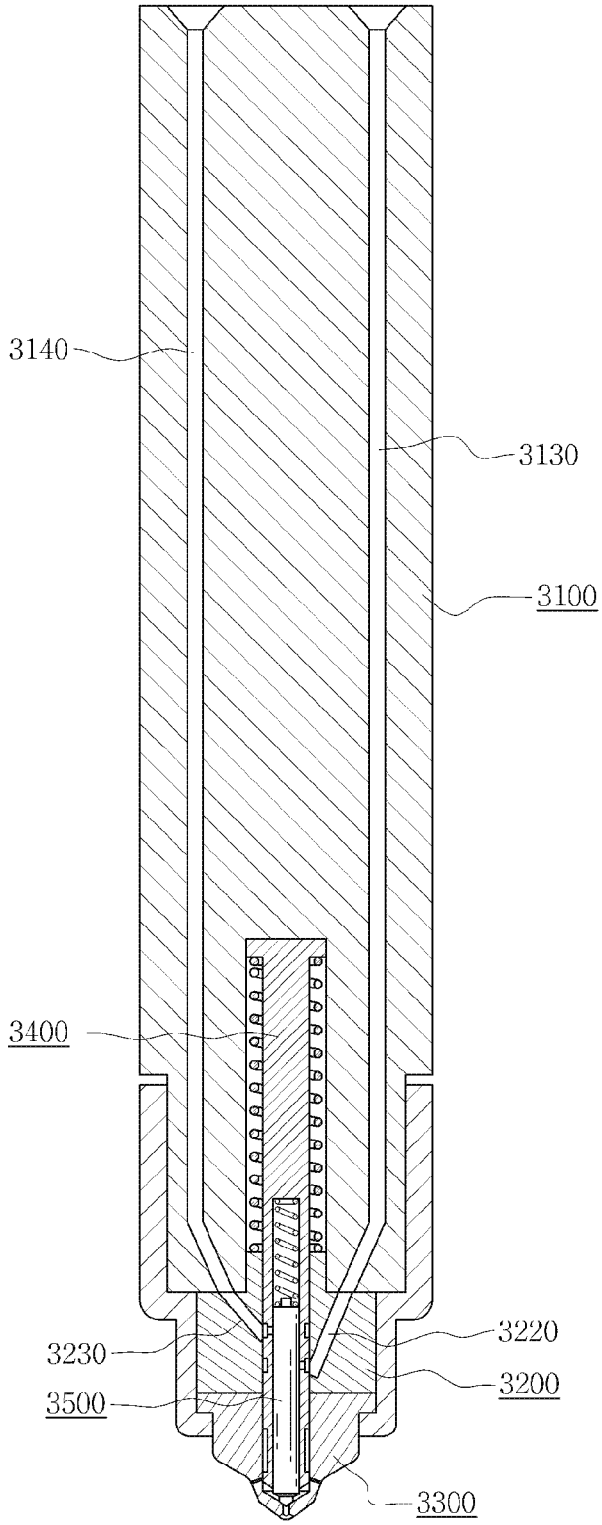
FIG. 15 is a cross-sectional view taken along an auxiliary fuel circulation line.
Figure 16:
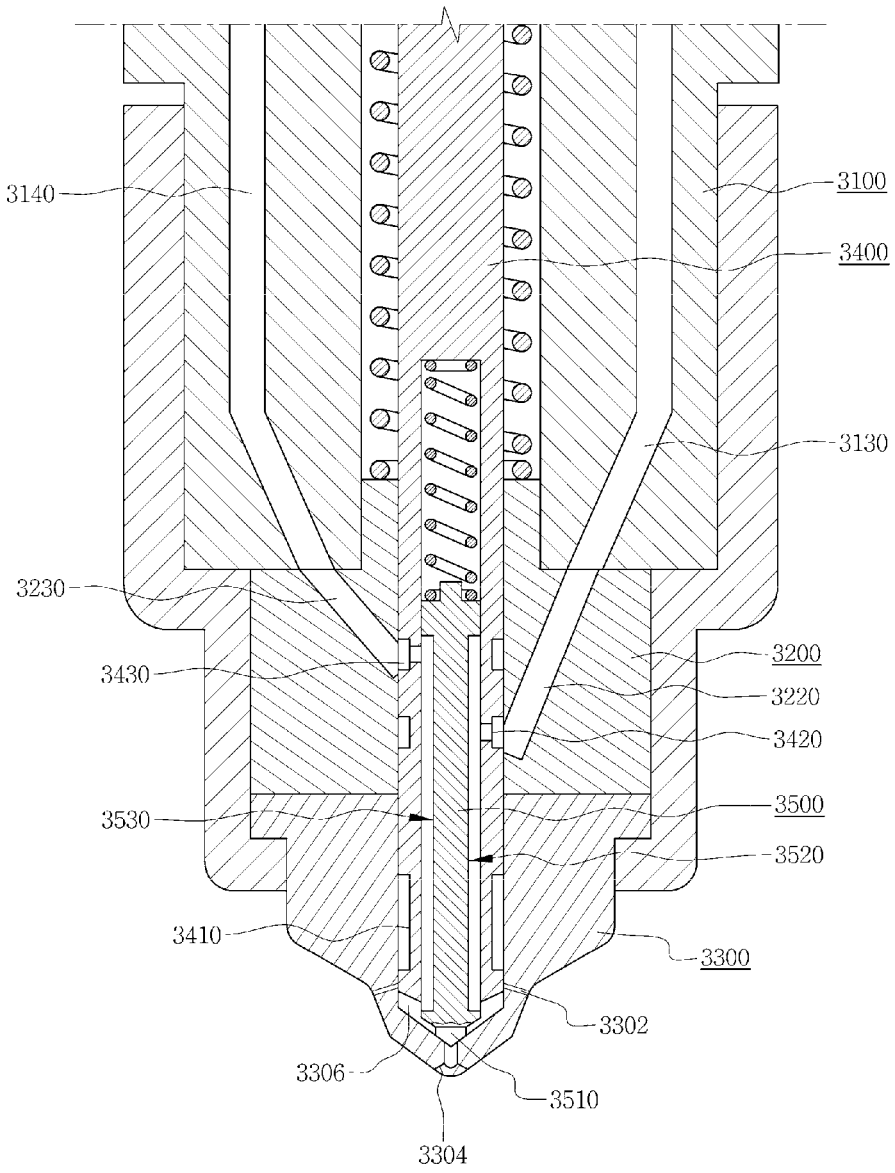
FIG. 16 is an enlarged view showing a head portion of FIG. 15.
Figure 17:
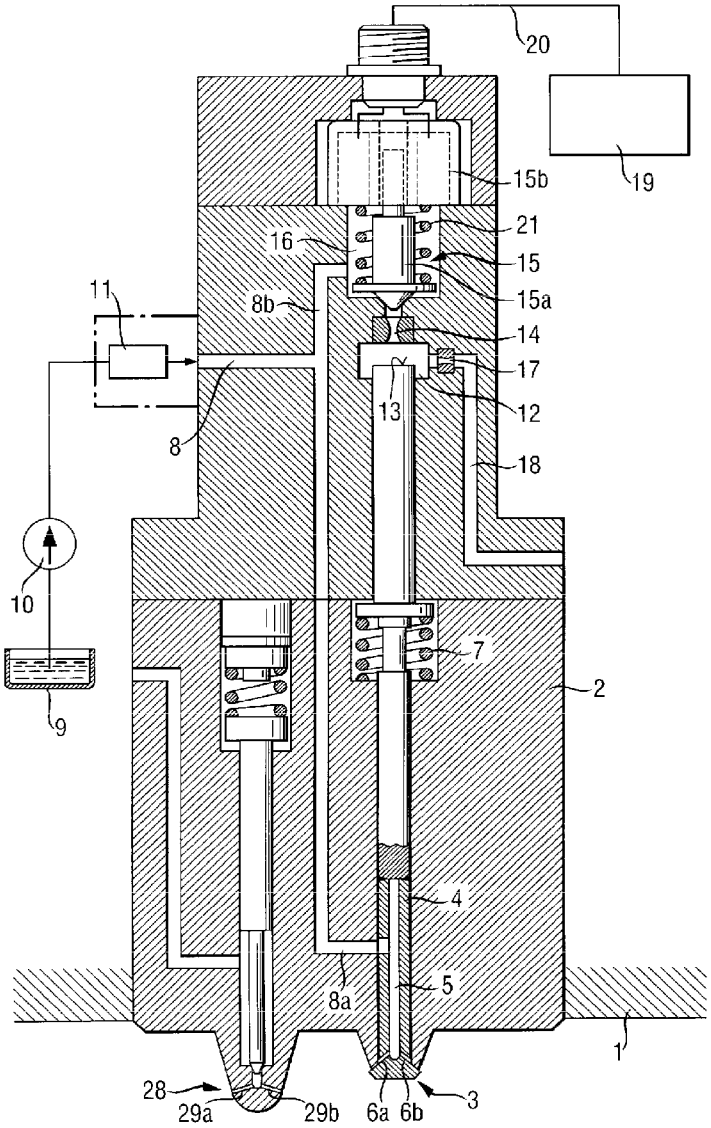
FIG. 17 is a diagram showing a general parallel twin injector.

FIGS. 13 to 16 show a two-stage fuel injection valve according to another embodiment of the present disclosure, where FIG. 13 is a cross-sectional view of the overall configuration, FIG. 14 is an enlarged view showing a head portion of FIG. 13, FIG. 15 is a cross-sectional view taken along an auxiliary fuel circulation line, and FIG. 16 is an enlarged view showing the head portion of FIG. 15.

The two-stage fuel injection valve shown in FIGS. 13 to 16 is slightly different from the injection valve illustrated in FIGS. 1 to 12 in view of the division number and shape of the injector body, the shapes of the main fuel line and the auxiliary fuel line, the shapes of the plunger and the needle, or the like. However, the injection valve of this embodiment is just slightly modified without departing from the technical spirit of the injection valve of the former embodiment.

As described above, the valve body may be configured by preparing several divided bodies divided in an axial direction and then assembling the prepared divided bodies in the axial direction. This embodiment shows an example of this technical spirit.

In other words, a valve body 3000 according to the present disclosure may be configured as an assembly where a first body 3100, a second body 3200 and a third body 3300 are axially coupled from the rear end toward the front end, as shown in FIGS. 13 and 14. In addition, a holder 3700 is coupled to the front end of the first body 3100 and surrounds and fixes the second body 3200 and the third body 3300.

The main fuel inflow passage has a first main fuel inflow passage 3110 and a second main fuel inflow passage 3120 extending from a main fuel inlet formed at the first body 3100, and third and fourth main fuel inflow passages 3210, 3310 formed at the second body 3200 and the third body 3300. In addition, a first main fuel chamber 3206 connected to the first main fuel inflow passage 3110 is formed.

The auxiliary fuel inflow passage has first and second auxiliary fuel inflow passages 3130, 3220 formed at the first body 3100 and the second body 3200.

Both the main fuel nozzle hole 3302 and the auxiliary fuel nozzle hole 3304 are formed at the third body 3300. The plunger 3400 is installed in the first main fuel chamber 3206, extends through the second body 3200 to the third body 3300, and defines an auxiliary fuel pressurizing chamber 3306 by the front end. The plunger 3400 is elastically pressurized toward the rear end by the plunger spring 3600.

A needle 3500 is installed in the plunger 3400. A needle end 3510 forming the front end of the needle 3500 closes the auxiliary fuel nozzle hole 3304. The needle 3500 is elastically pressurized toward the front end by the needle spring 3650.

The second main fuel chamber 3410 is also formed with a groove shape along the outer circumference of the plunger 3400, like the former embodiment.

Similarly, an auxiliary fuel inflow chamber 3420 and an auxiliary fuel discharge chamber 3430 are also formed as a groove and a communication hole at the outer circumference of the plunger 3400.

In addition, a first elongated groove 3520 and a second elongated groove 3530 are formed at the needle 3500.

FIGS. 15 and 16 are cross-sectional views taken in different directions for illustrating the auxiliary fuel discharge passage system. The auxiliary fuel discharge passage is configured by forming first and second discharge passages 3140, 3230 respectively at the first and second bodies 3100, 3200. The second discharge passage 3230 communicates with the auxiliary fuel discharge chamber 3430.

As described above, the injection valve depicted in FIGS. 13 to 16 is configured based on the same technical spirit as the injection valve of the former embodiment and also has substantially the same fuel injection operation, even though there is a slight difference. Therefore, this will be not described in detail.

While the exemplary embodiments have been shown and described, it will be understood by those skilled in the art that various changes in form and details may be made thereto without departing from the spirit and scope of this disclosure as defined by the appended claims. In addition, many modifications can be made to adapt a particular situation or material to the teachings of this disclosure without departing from the essential scope thereof. Therefore, it is intended that this disclosure not be limited to the particular exemplary embodiments disclosed as the best mode contemplated for carrying out this disclosure, but that this disclosure will include all embodiments falling within the scope of the appended claims.

INDUSTRIAL APPLICABILITY

According to the present disclosure, two-stage fuel injection and dual fuel injection may be performed by using a single mechanical injector, with a simple structure.

In addition, the main nozzle hole and the auxiliary nozzle hole may be selectively opened or closed by using a single mechanical fuel injection valve, and the auxiliary fuel may be compressed by means of the pressure received from the main fuel. Therefore, the auxiliary fuel may be compressed with a simple structure, and a separate injection pump is not needed to compress the auxiliary fuel.

Moreover, since two kinds of fuels are coaxially injected in a radial direction at the center of the combustion chamber, the fuel performance may be improved.

The invention claimed is:

1. A two-stage fuel injection valve for injecting a fuel into a combustion chamber of a cylinder head, the valve comprising:

a valve body having a plurality of main fuel nozzle holes and a plurality of auxiliary fuel nozzle holes radially formed at points axially spaced apart from the front end based on the same center axis, a main fuel inflow passage formed from a main fuel inlet to a point adjacent to the main fuel nozzle hole, a first main fuel chamber axially formed to communicate with the main fuel inflow passage, an auxiliary fuel inflow passage formed from an auxiliary fuel inlet to a point adjacent to the auxiliary fuel nozzle hole, and an auxiliary fuel discharge passage formed from another point adjacent to the auxiliary fuel nozzle hole;

a plunger inserted into the first main fuel chamber of the valve body to be axially slidable so that an auxiliary fuel pressurizing chamber is formed between the front end and the valve body to communicate with the auxiliary fuel nozzle hole, advancing forwards with the pressure of a main fuel applied to the first main fuel chamber to pressurize an auxiliary fuel in the auxiliary fuel pressurizing chamber, and allowing the main fuel inflow passage to communicate with the main fuel nozzle hole after an auxiliary fuel injection completion point;

a plunger spring for elastically pressurizing the plunger in a retreating direction;

a needle inserted into the center of the plunger to be slidable in an axial direction, the needle having a needle end at the front end thereof to close the auxiliary fuel nozzle hole, the needle retreating by means of pressure increase of the auxiliary fuel pressurizing chamber so that the auxiliary fuel pressurizing chamber communicates with the auxiliary fuel nozzle hole; and a needle spring interposed between the rear end of the needle and the plunger to elastically pressurize the needle in the advancing direction.

2. The two-stage fuel injection valve according to claim 1, wherein a second main fuel chamber communicating with a terminal of the main fuel inflow passage is formed along the outer circumference of the front end of the plunger in a groove shape, the main fuel nozzle hole is closed when the plunger retreats, and the main fuel inflow passage communicates with the main fuel nozzle hole when plunger advances forwards.

3. The two-stage fuel injection valve according to claim 1, wherein an auxiliary fuel inflow chamber communicating with a terminal of the auxiliary fuel inflow passage and an auxiliary fuel discharge chamber communicating with a terminal of the auxiliary fuel discharge passage are formed at the outer circumference of the plunger, and wherein a first elongated groove connecting the auxiliary fuel inflow chamber to the auxiliary fuel pressurizing chamber and a second elongated groove for connecting the auxiliary fuel pressurizing chamber to the auxiliary fuel discharge chamber are formed at the outer circumference of the needle, and the first elongated groove and the second elongated groove communicate with the auxiliary fuel pressurizing chamber or are closed by means of retreat or advance of the plunger.

4. The two-stage fuel injection valve according to claim 3, wherein the auxiliary fuel inflow chamber has a groove formed along the outer circumference of the plunger, and a communication hole connecting the groove to the first elongated groove of the needle, and wherein the auxiliary fuel discharge chamber has a groove formed along the outer circumference of the plunger, and a communication hole connecting the groove to the second elongated groove of the needle.

5. The two-stage fuel injection valve according to claim 1, wherein the valve body is configured as an assembly of a plurality of divided bodies divided in an axial direction.

6. The two-stage fuel injection valve according to claim 1, wherein the valve body includes:

a base body having a main fuel inlet, a first main fuel inflow passage, an auxiliary fuel inlet and a first auxiliary fuel inflow passage, and a nozzle body having the first main fuel chamber, the main fuel nozzle hole and the auxiliary fuel nozzle hole and assembled to the base body in an axial direction, the nozzle body having a second main fuel inflow passage connected to the first main fuel inflow passage and a second auxiliary fuel inflow passage connecting the first auxiliary fuel inflow passage to the auxiliary fuel pressurizing chamber.

7. The two-stage fuel injection valve according to claim 1, wherein the valve body is configured as an assembly where a first body, a second body and a third body are coupled in an axial direction from the rear end toward the front end, and a holder is coupled to the front end of the first body to surround and fix the second body and the third body.

* * * * *